US008122858B2

(12) United States Patent
Fujimoto

(10) Patent No.: US 8,122,858 B2
(45) Date of Patent: Feb. 28, 2012

(54) ABNORMALITY DIAGNOSIS APPARATUS FOR COOLING SYSTEM OF VEHICLE

(75) Inventor: Takeshi Fujimoto, Obu (JP)

(73) Assignee: Denso Corporation, Kariya (JP)

( * ) Notice: Subject to any disclaimer, the term of this patent is extended or adjusted under 35 U.S.C. 154(b) by 324 days.

(21) Appl. No.: 12/614,691

(22) Filed: Nov. 9, 2009

(65) Prior Publication Data

US 2010/0116228 A1 May 13, 2010

(30) Foreign Application Priority Data

Nov. 10, 2008 (JP) ..... 2008-287343

(51) Int. Cl.
*F01P 7/16* (2006.01)
*F01P 7/14* (2006.01)

(52) U.S. Cl. ..... 123/41.1; 73/114.68

(58) Field of Classification Search ..... 123/41.1, 123/41.08, 41.15, 41.05; 701/114; 73/114.68, 73/114.77

See application file for complete search history.

(56) References Cited

U.S. PATENT DOCUMENTS

| | | | | |
|---|---|---|---|---|
| 6,279,390 | B1 | 8/2001 | Oka et al. | |
| 7,111,506 | B2 * | 9/2006 | Tsukamoto et al. | 73/114.68 |
| 2002/0111734 | A1 | 8/2002 | Wakahara et al. | |
| 2007/0034172 | A1 * | 2/2007 | Miyahara et al. | 123/41.1 |

* cited by examiner

*Primary Examiner* — Mahmoud Gimie
(74) *Attorney, Agent, or Firm* — Nixon & Vanderhye PC

(57) ABSTRACT

A coolant circuit circulates coolant between an internal combustion engine and a radiator of a vehicle and is provided with a thermostat. A control unit obtains radiator side released heat amount information, which indicates the amount of heat released from coolant through the radiator or information relevant to the amount of heat released from the coolant through the radiator. The control unit determines whether a thermostat open state abnormality exists by determining whether a predetermined thermostat abnormal time correlation exists between the radiator side released heat amount information and a vehicle speed of the vehicle in a warm-up incomplete temperature range of the coolant.

16 Claims, 9 Drawing Sheets

ABNORMALITY DIAGNOSIS APPARATUS FOR COOLING SYSTEM OF VEHICLE

CROSS REFERENCE TO RELATED APPLICATION

This application is based on and incorporates herein by reference Japanese Patent Application No. 2008-287343 filed on Nov. 10, 2008.

BACKGROUND OF THE INVENTION

1. Field of the Invention

The present invention relates to an abnormality diagnosis apparatus for a cooling system of a vehicle, which includes a coolant circuit that circulates coolant between an internal combustion engine and a radiator of the vehicle and is provided with a thermostat.

2. Description of Related Art

In general, in a cooling system for cooling an internal combustion engine installed in a vehicle, a thermostat (also referred to as a thermostat valve or a thermo valve) is provided in a coolant circuit that circulates coolant between the engine and a radiator. When the coolant temperature is lower than a predetermined temperature (e.g., a temperature of the coolant at a warm-up complete state of the engine), the thermostat is closed to stop the circulation of the coolant between the engine and the radiator. In this way, the coolant temperature at the engine side is rapidly increased, and thereby the warm-up operation of the engine is facilitated. Thereafter, when the coolant temperature becomes equal to or higher than the predetermined temperature, the thermostat is opened to circulate the coolant between the engine and the radiator. In this way, the coolant temperature is adjusted within an appropriate warm-up temperature range, and thereby the overheat of the engine is limited.

However, when an abnormality (known as a thermostat open state abnormality) occurs in the thermostat in a warm-up incomplete temperature range of the coolant, which is lower than the predetermined temperature described above, the thermostat is left opened. When the thermostat open state abnormality occurs, the coolant of the engine, which is in the middle of the warm-up operation, is circulated to the radiator and releases the heat through the radiator. Therefore, the temperature of the coolant in the radiator cannot be rapidly increased, and thereby completion of the warm-up operation of the engine is delayed. As a result, emissions of the engine may be disadvantageously increased, and the fuel consumption may be disadvantageously increased. Therefore, when the thermostat open state abnormality occurs, such an abnormality should be sensed in an early stage, and a warning should be provided to a driver (user).

In order to address the above disadvantage, as recited in, for example, Japanese patent No. 3407572 (corresponding to U.S. Pat. No. 6,279,390B1), the amount of change in an accurately measured coolant temperature, which is measured with a coolant temperature sensor, is compared with a determination reference temperature to determine whether the open state abnormality of the thermostat exists within a predetermined time period upon starting of the engine.

Also, as recited in, for example, Japanese Patent No. 3956663 (corresponding to US 2002/0111734A1), the coolant temperature is estimated based on the amount of coolant temperature increase caused by the generation of heat from the engine and the amount of decrease in the coolant temperature caused by the release of heat from the coolant through the radiator upon application of air flow, which is generated by the forward movement of the vehicle or a radiator fan and is applied to the radiator. Then, the estimated coolant temperature and the measured coolant temperature are compared with each other to determine whether the thermostat abnormality exists.

In the above abnormality diagnosis techniques, the coolant temperature, which is measured with the coolant temperature sensor, or the amount of change in the measured coolant temperature is compared with the estimated coolant temperature or the determination reference temperature to determine whether the coolant temperature shows the behavior of the normal time and thereby to diagnose the abnormality of the thermostat. In order to increase the accuracy of the abnormality diagnosis, the accuracy of estimation of the coolant temperature and/or the accuracy of the determination reference temperature should be increased. In order to increase the accuracy of the estimation of the coolant temperature and/or the accuracy of the determination reference temperature, the estimation method for estimating the coolant temperature and/or the determination reference temperature should be accurately adapted by measuring the amount of heat generated from the engine and the amount of heat released from the engine under various driving conditions and the traveling conditions of the vehicle through use of the actual vehicle. This adaptation disadvantageously requires a large number of steps.

SUMMARY OF THE INVENTION

The present invention addresses the above disadvantages. According to the present invention, there is provided an abnormality diagnosis apparatus for a cooling system of a vehicle, which includes a coolant circuit that circulates coolant between an internal combustion engine and a radiator of the vehicle and is provided with a thermostat. The thermostat is closed in a predetermined warm-up incomplete temperature range of the coolant, in which warm-up of the internal combustion engine is determined to be incomplete, to stop the circulation of the coolant between the internal combustion engine and the radiator. The abnormality diagnosis apparatus includes a radiator side released heat amount information obtaining means and an abnormality diagnosis means. The radiator side released heat amount information obtaining means is for obtaining radiator side released heat amount information, which indicates an amount of heat released from the coolant through the radiator or information relevant to the amount of heat released from the coolant through the radiator. The abnormality diagnosis means is for determining whether a thermostat open state abnormality, which is an abnormality of the thermostat that disables closing of the thermostat in the warm-up incomplete temperature range of the coolant and thereby leaves the thermostat opened in the warm-up incomplete temperature range of the coolant, exists by determining whether a predetermined thermostat abnormal time correlation exists between the radiator side released heat amount information and a vehicle speed of the vehicle in the warm-up incomplete temperature range of the coolant.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

First Embodiment

A first embodiment of the present invention will be described with reference to FIGS. 1 to 8.

Figure 1:
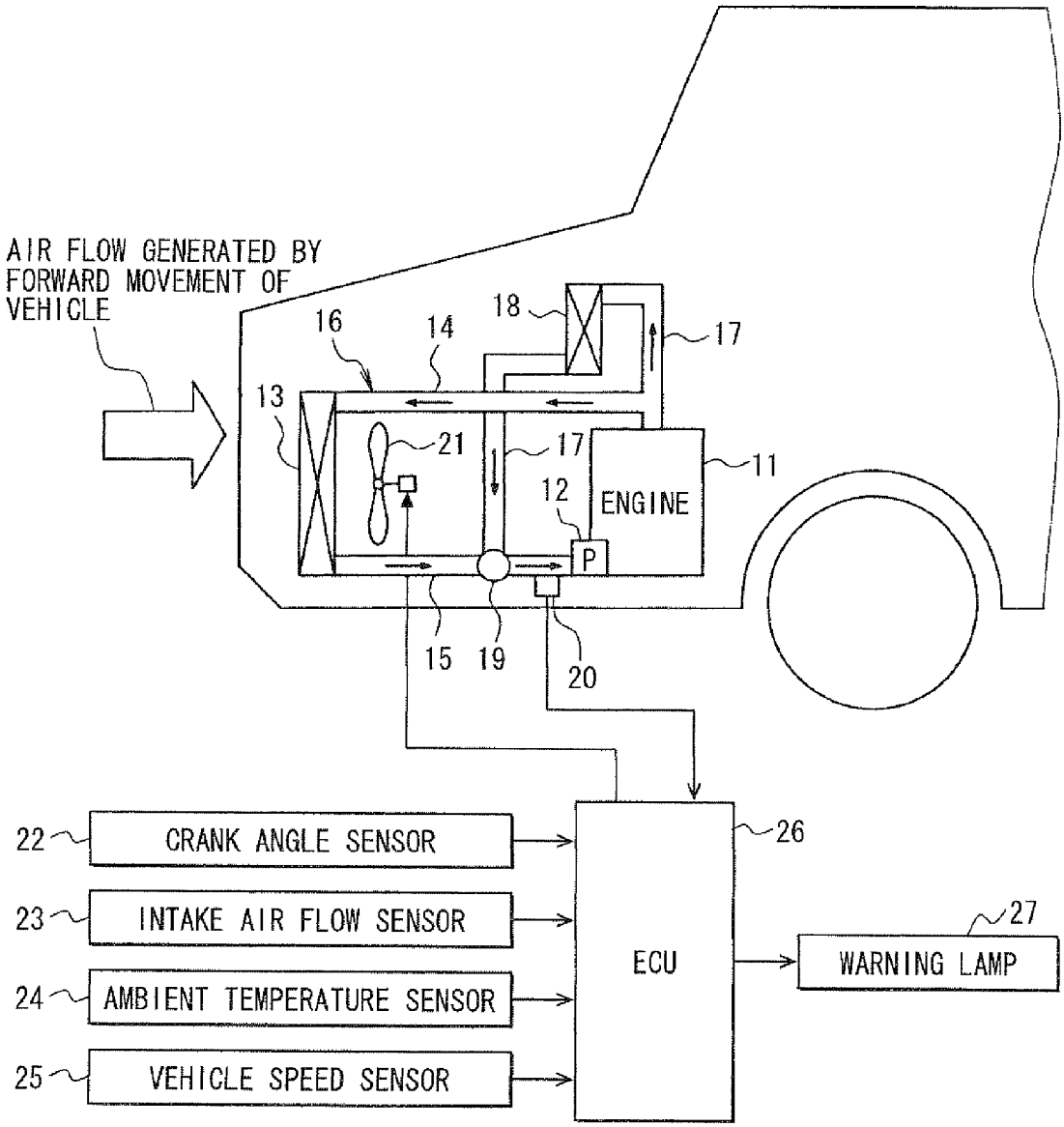
FIG. 1 is a schematic diagram showing an engine cooling system according to a first embodiment of the present invention.

First of all, an entire structure of an engine cooling system of the present embodiment will be briefly described with reference to FIG. 1.

A water pump 12 is provided at an inlet of a coolant passage (water jacket) of an internal combustion engine (hereinafter, simply referred to as an engine) 11. The water pump 12 may be a mechanical water pump, which is driven by a drive force of the engine 11, or an electric water pump, which is driven by an electric motor. A coolant circulation pipe 14 communicates between an outlet of the coolant passage of the engine 11 and an inlet of the radiator 13, and a coolant circulation pipe 15 communicates between an outlet of the radiator 13 and an inlet of the water pump 12. In this way, a coolant circuit 16 is formed to circulate the coolant through the coolant passage of the engine 11, the coolant circulation pipe 14, the radiator 13, the coolant circulation pipe 15 and the water pump 12. A hot coolant circuit 17 is connected to the coolant circuit 16 in parallel with the engine 11, and a heating heater core 18 is inserted in the hot coolant circuit 17.

Furthermore, a thermostat (a thermostat valve or a thermo valve) 19, which is opened and closed in response to the coolant temperature, is inserted in a portion of the coolant circuit 16 (specifically, a connection between the coolant circulation pipe 15 and the hot coolant circuit 17 on the downstream side of the radiator 13). When the coolant temperature is in a predetermined warm-up incomplete temperature range, the thermostat 19 is closed to stop the circulation of the coolant between the engine 11 and the radiator 13. The warm-up incomplete temperature range is a temperature range of the coolant, in which warm-up of the engine 11 is determined to be incomplete and which is lower than a predetermined temperature (a temperature corresponding to a warm-up complete state coolant temperature, equal to or above which the warm-up operation of the engine 11 is determined to be completed). With this closing operation of the thermostat 19, the coolant temperature in the interior of the engine 11 is rapidly increased to promote the warm-up of the engine 11. Thereafter, when the coolant temperature becomes equal to or higher than the predetermined temperature, the thermostat 19 is opened to circulate the coolant between the engine 11 and the radiator 13, so that the coolant temperature is adjusted to an appropriate warm-up temperature range through heat release at the radiator 13 to limit the overheat of the engine 11. When the heating operation for heating the interior of the passenger compartment of the vehicle is not performed, the circulation of the coolant in the hot coolant circuit 17 is kept stopped.

A coolant temperature sensor 20, which measures the coolant temperature (the temperature of the coolant on the engine 11 side of the thermostat 19 in the coolant circuit 16), is provided at an inlet of the coolant passage of the engine 11 in the coolant circuit 16. Furthermore, an electric radiator fan 21, which is driven to generate a cooling air flow applied to the radiator 13 upon energization thereof, is provided at a location adjacent to the radiator 13.

Furthermore, a crank angle sensor 22, which outputs a pulse signal at every predetermined crank angle of the crankshaft, is installed to a cylinder block of the engine 11. The crank angle and the engine rotational speed are sensed based on the output signal of the crank angle sensor 22. Furthermore, an intake air quantity (intake air flow quantity) is sensed with an intake air flow sensor 23, such as an air flow meter. An ambient temperature, which is the temperature of the air at the surrounding environment outside of the coolant circuit 16, is sensed with an ambient temperature sensor 24, and a speed (vehicle speed) of the vehicle is sensed with a vehicle speed sensor 25.

Outputs of the above-described sensors are supplied to an engine control unit (ECU) 26. The ECU 26 includes a microcomputer as its main component. When the ECU 26 executes engine control programs, which are stored in a ROM (a storage) of the ECU 26, a fuel injection quantity of each fuel injection valve (not shown) and ignition timing of a corresponding spark plug (not shown) are controlled based on the operational state of the engine 11.

In the normal operational period of the thermostat 19, the thermostat 19 is closed when the coolant temperature is in the warm-up incomplete temperature range, which is lower than the predetermined temperature (e.g., the temperature that corresponds to the warm-up compete state temperature), so that the circulation of the coolant between the engine 11 and the radiator 13 is stopped. Thereby, the low temperature coolant (the coolant having the temperature that is generally equal to the ambient temperature) remains in the radiator 13. Therefore, even when the vehicle speed is increased to increase the amount of air flow, which is generated by the forward movement of the vehicle and is applied to the radiator 13, the amount of heat released from the coolant through the radiator 13 does not change substantially.

In contrast, in the state where the coolant temperature is in the warm-up incomplete temperature range, when an abnormality of the thermostat 19 occurs, the thermostat 19 may not be closed and may be left opened. This abnormality will be hereinafter referred to as a thermostat open state abnormality. When the thermostat open state abnormality occurs, the coolant in the engine 11, which is in the middle of the warm-up operation, is circulated to the radiator 13 and releases the heat through the radiator 13. Thus, when the vehicle speed is increased to increase the amount of air flow, which is generated by the forward movement of the vehicle and is applied to the radiator 13, the amount of heat released from the coolant through the radiator 13 is increased. Furthermore, in response to the increase in the amount of heat released from the coolant through the radiator 13, the measured coolant temperature, which is measured with the coolant temperature sensor 20 (the temperature of the coolant on the engine 11 side of the thermostat 19 in the coolant circuit 16), is changed.

Thus, when the open state abnormality of the thermostat 19 occurs in the warm-up incomplete temperature range of the coolant, a relationship between the amount of change Δthw (radiator side released heat amount information) in the actually measured coolant temperature and the vehicle speed V becomes as follows. That is, when the vehicle speed V is increased, the amount of change Δthw in the measured coolant temperature is reduced (i.e., resulting in a decrease in the increasing rate of the measured coolant temperature or an increase in the decreasing rate of the measured coolant temperature).

In view of the above characteristics, according to the first embodiment, respective routines, which are shown in FIGS. 3 to 8 and will be described later, are executed by the ECU 26. Thereby, a first abnormality diagnosis operation is executed. Specifically, it is determined whether a predetermined thermostat abnormal time correlation (see FIG. 2) exists between the amount of change Δthw in the measured coolant temperature and the vehicle speed V in the state where the coolant temperature is in the warm-up incomplete temperature range, which is lower than the predetermined temperature. In this way, it is determined whether the thermostat open state abnormality (the abnormality, which causes the thermostat 19 to be left opened in the warm-up incomplete temperature range of the coolant) exists.

Figure 2:
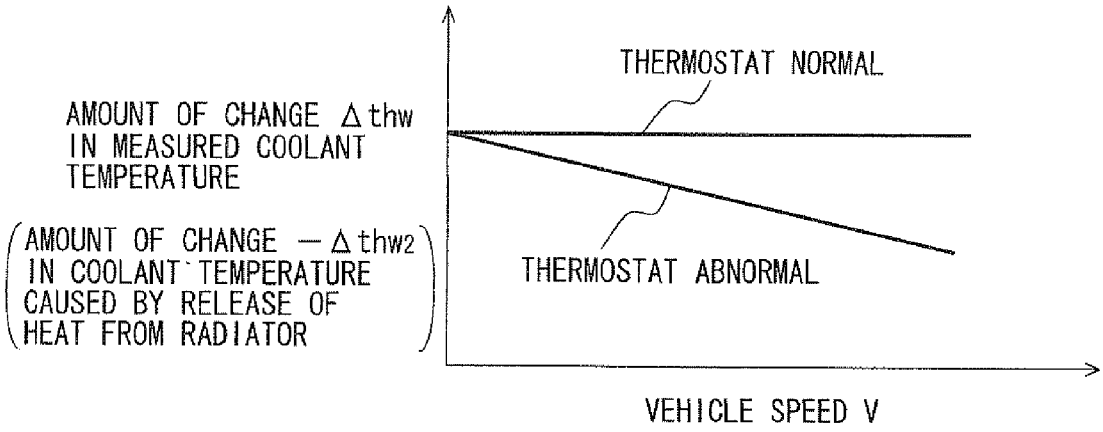
FIG. 2 is a diagram showing correlation between the amount of change in the coolant temperature at abnormal time and a vehicle speed.

Specifically, the amount of change cf (abnormal time radiator side released heat amount information) in the abnormal time coolant temperature corresponding to the vehicle speed V is computed by using the thermostat abnormal time correlation (see FIG. 2). Then, a difference (cf−Δthw) between the amount of change cf in the abnormal time coolant temperature and the amount of change Δthw in the measured coolant temperature is computed as a correlation value. Then, this correlation value is evaluated to determine whether the thermostat abnormal time correlation exists between the amount of change Δthw in the measured coolant temperature and the vehicle speed V. When the relationship between the amount of change Δthw in the measured coolant temperature and the vehicle speed V approaches the thermostat abnormal time correlation, the difference (cf−Δthw) between the amount of change cf in the abnormal time coolant temperature and the amount of change Δthw in the measured coolant temperature is reduced. Therefore, when the difference (cf−Δthw) between the amount of change cf in the abnormal time coolant temperature and the amount of change Δthw in the measured coolant temperature is evaluated as the correlation value, it is possible to accurately determine whether the thermostat abnormal time correlation exists between the amount of change Δthw in the measured coolant temperature and the vehicle speed V.

Furthermore, according to the first embodiment, a second abnormality diagnosis operation is executed. Specifically, in the state where the coolant temperature is in the warm-up incomplete temperature range, the coolant temperature is estimated based on the amount of increase in the coolant temperature, which is caused by the heat generation at the engine 11, and the amount of decrease in the coolant temperature, which is caused by the heat release from, for example, the radiator 13 and the heater core 18. Then, it is determined whether the thermostat open state abnormality exists based on the measured coolant temperature, which is measured with the coolant temperature sensor 20, and the estimated coolant temperature. Then, when the result of the first abnormality diagnosis operation (the abnormality diagnosis operation executed by using the thermostat abnormal time correlation) is the same as, i.e., is identical to the result of the second abnormality diagnosis operation (the abnormality diagnosis operation executed by using the estimated coolant temperature), this identical abnormality diagnosis result is used as the final abnormality diagnosis result.

In the case where the coolant of the engine 11 is circulated to the radiator 13 during the warm-up operation of the engine 11 upon occurrence of the thermostat open state abnormality, when the amount of air flow, which is generated by the forward movement of the vehicle and is applied to the radiator 13, is small due to the low vehicle speed, the amount of heat released at the radiator 13 is small. In such a case, it may not be accurately determined whether the thermostat abnormal time correlation exists between the amount of change Δthw in the measured coolant temperature and the vehicle speed V.

Therefore, according to the first embodiment, in the case where the vehicle speed V does not satisfy a predetermined condition during the period of executing the first abnormality diagnosis operation, the radiator fan 21 is forcefully driven, and the vehicle speed V, which is used to determine the correlation between the amount of change Δthw in the measured coolant temperature and the vehicle speed V, is corrected based on the operational state of the radiator fan 21.

The abnormality diagnosis of the thermostat 19 of the first embodiment is executed when the ECU 26 executes the abnormality diagnosis routines shown in FIGS. 3 to 8. The procedure of each of these routines will now be described in detail.

Figure 3:
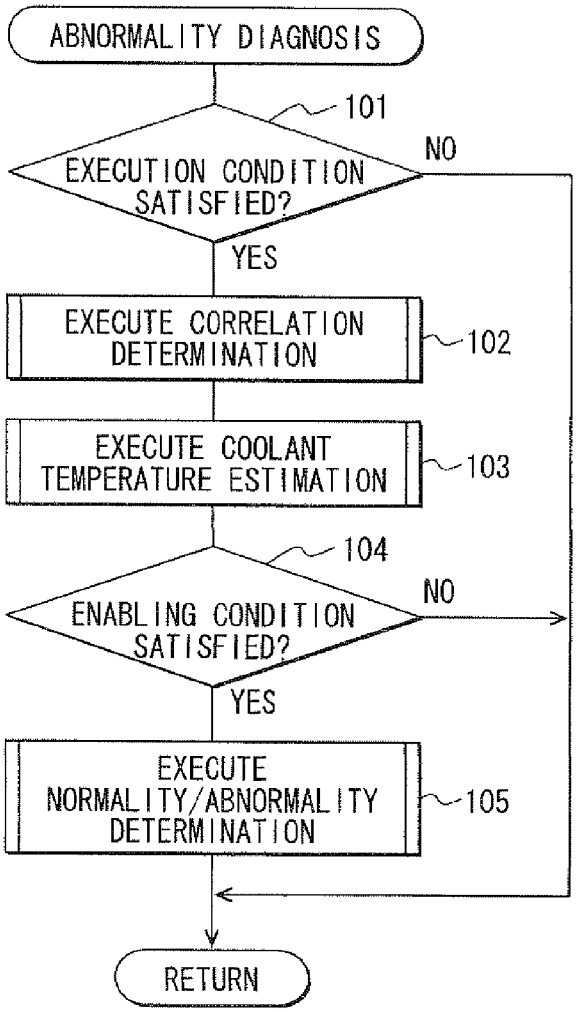
FIG. 3 is a flowchart showing a flow of an abnormality diagnosis main routine according to the first embodiment.

An abnormality diagnosis main routine will now be described. The abnormality diagnosis main routine of FIG. 3 is executed at predetermined intervals while the power supply to the ECU 26 is turned on. This routine serves as an abnormality diagnosis means. Upon starting this routine, at step 101, it is determined whether a predetermined diagnosis execution condition is satisfied. For instance, the predetermined diagnosis execution condition is satisfied when the coolant temperature sensor 20 is normal, and the coolant temperature is in the warm-up incomplete temperature range, which is lower than the predetermined temperature. When it is determined that the abnormality diagnosis execution condition is not satisfied at step 101, the present routine is terminated without further executing the abnormality diagnosis operation at and after step 102.

Figure 4:
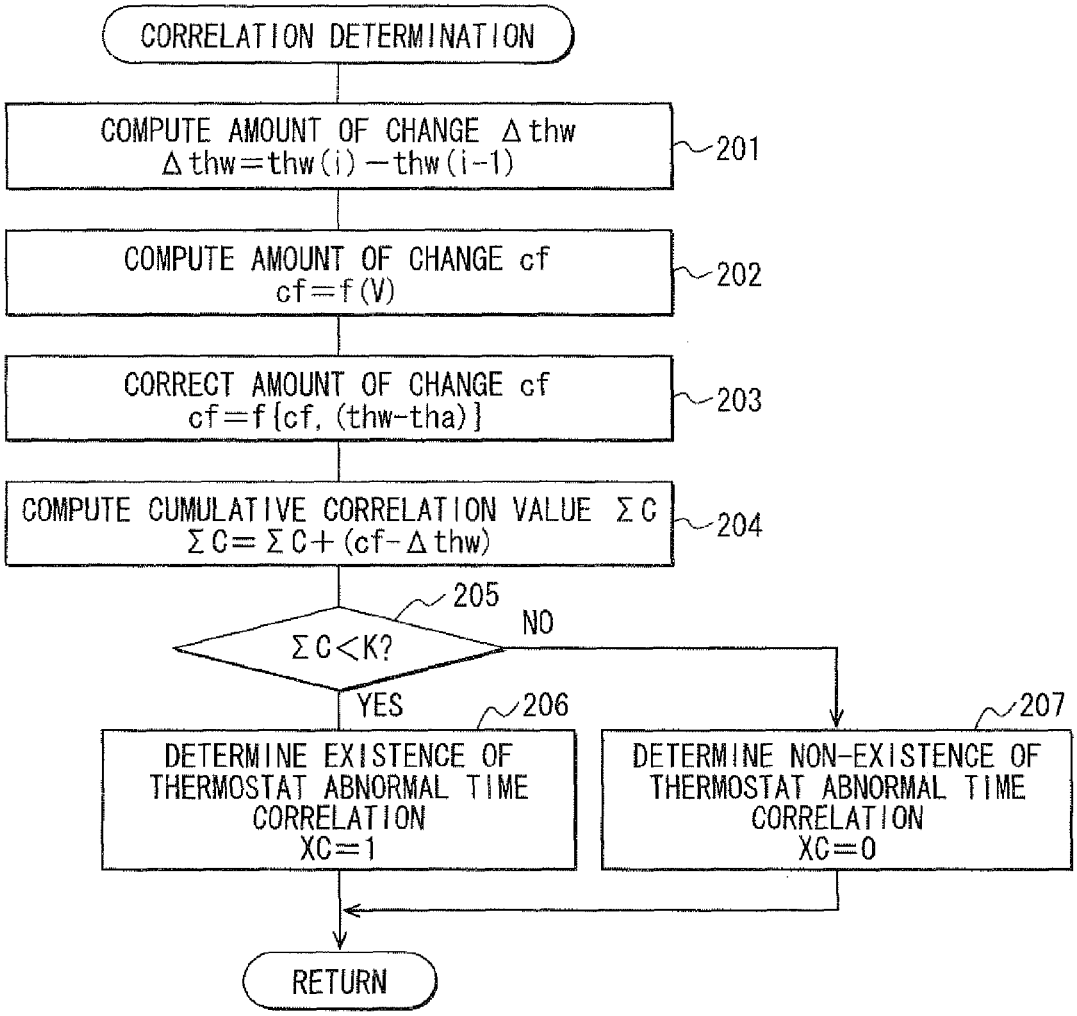
FIG. 4 is a flowchart showing a flow of a correlation determination routine according to the first embodiment.

In contrast, when it is determined that the abnormality diagnosis execution condition is satisfied at step 101, the abnormality diagnosis operation at and after step 102 is executed in the following manner. First of all, at step 102, a correlation determination routine of FIG. 4 is executed to determine whether the thermostat abnormal time correlation (see FIG. 2) exists between the amount of change Δthw in the measured coolant temperature and the vehicle speed V.

Figure 5:
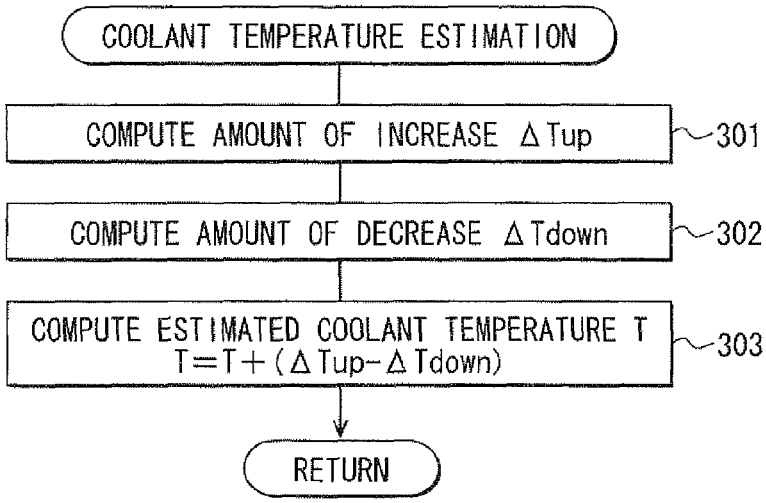
FIG. 5 is a flowchart showing a flow of a coolant temperature estimation routine according to the first embodiment.

Thereafter, the operation proceeds to step 103 where a coolant temperature estimation routine of FIG. 5 is executed to estimate the coolant temperature based on the amount of increase in the coolant temperature, which is caused by the heat generation at the engine 11, and the amount of decrease in the coolant temperature, which is caused by the heat release from, for example, the radiator 13 and the heater core 18.

Thereafter, the operation proceeds to step 104. At step 104, it is determined whether a predetermined determination enabling condition is satisfied. For example, the predetermined determination enabling condition is satisfied when a cumulative value of the measured vehicle speeds, which have been cumulated since the time of satisfying the predetermined abnormality diagnosis execution condition, becomes larger than a corresponding predetermined value. Alternatively, the determination enabling condition may be satisfied, for example, when the number of times of executing the computation of the correlation value is larger than a corresponding predetermined number, or when an average of the measured vehicle speeds is larger than a corresponding predetermined value.

Figure 6:
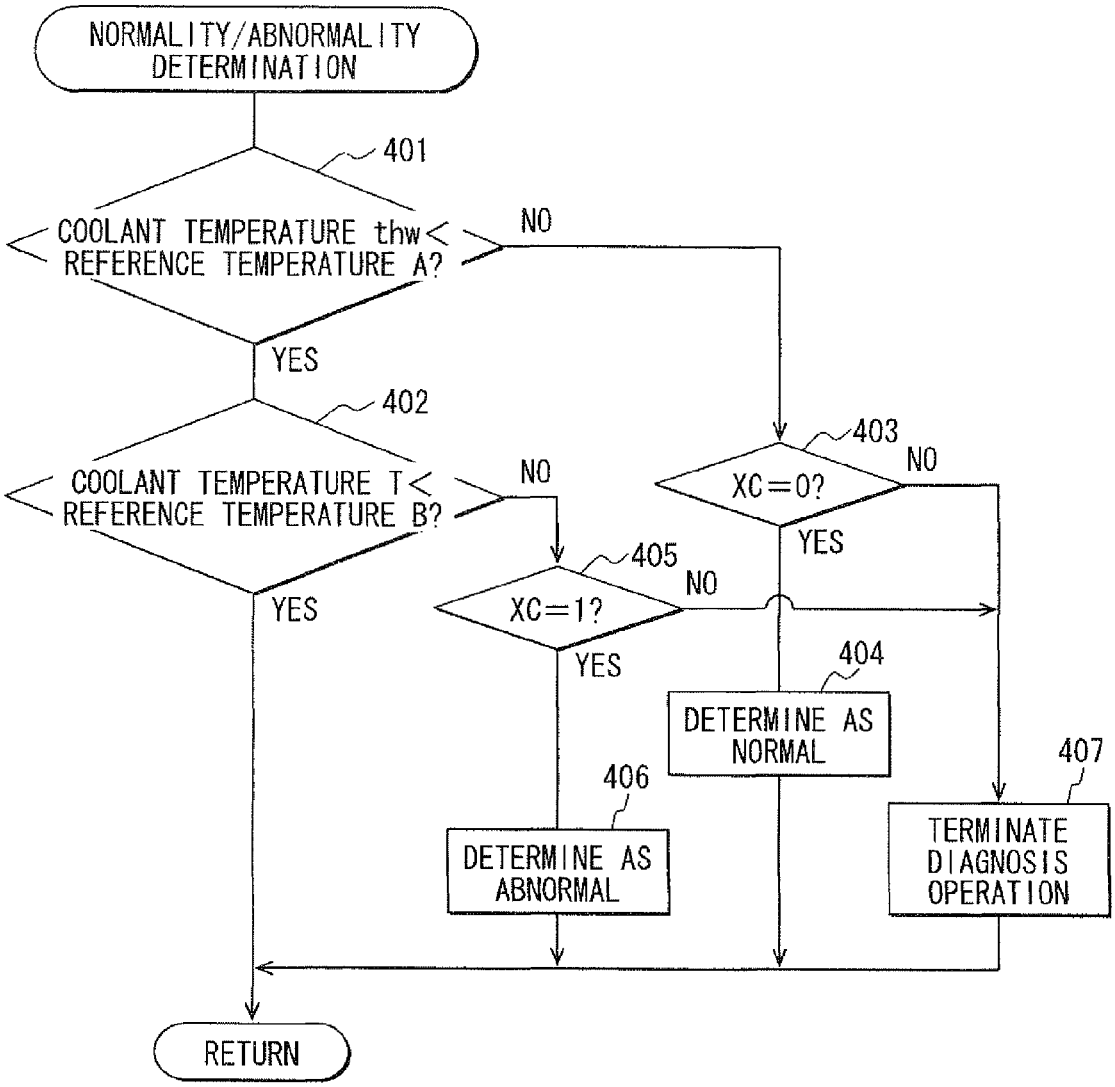
FIG. 6 is a flowchart showing a flow of a normality/abnormality determination routine according to the first embodiment.

When it is determined that the determination enabling condition is satisfied at step 104, it is determined that the correlation between the amount of change Δthw in the measured coolant temperature and the vehicle speed V can be accurately determined. Then, the operation proceeds to step 105. At step 105, a normality/abnormality determination routine shown in FIG. 6 is executed to determine whether the thermostat abnormal time correlation exists between the amount of change Δthw in the measured coolant temperature and the vehicle speed V. In this way, it is determined whether the thermostat open state abnormality exists. Specifically, the first abnormality diagnosis operation is executed to determine whether the thermostat open state abnormality exists based on whether the thermostat abnormal time correlation exists between the amount of change Δthw in the measured coolant temperature and the vehicle speed V. Also, the second abnormality diagnosis operation is executed to determine whether the thermostat open state abnormality exists based on the measured coolant temperature and the estimated coolant temperature. When the result of the first abnormality diagnosis operation and the result of the second abnormality diagnosis operation are identical to each other, this identical abnormality diagnosis result is used as the final abnormality diagnosis result.

A correlation determination routine shown in FIG. 4 is a subroutine, which is executed at step 102 of the abnormality diagnosis main routine shown in FIG. 3. Upon starting of the present routine, at step 201, a difference between the currently measured coolant temperature thw(i), which is measured with the coolant temperature sensor 20, and the previously measured coolant temperature thw(i−1), which has been previously measured with the coolant temperature sensor 20 before the current time, is computed to obtain the amount of change Δthw in the measured coolant temperature per predetermined time period (e.g., per computation cycle of the present routine).

$$\Delta thw = thw(i) - thw(i-1)$$

This process at step 201 serves as a radiator side released heat amount information obtaining means.

Figure 8:
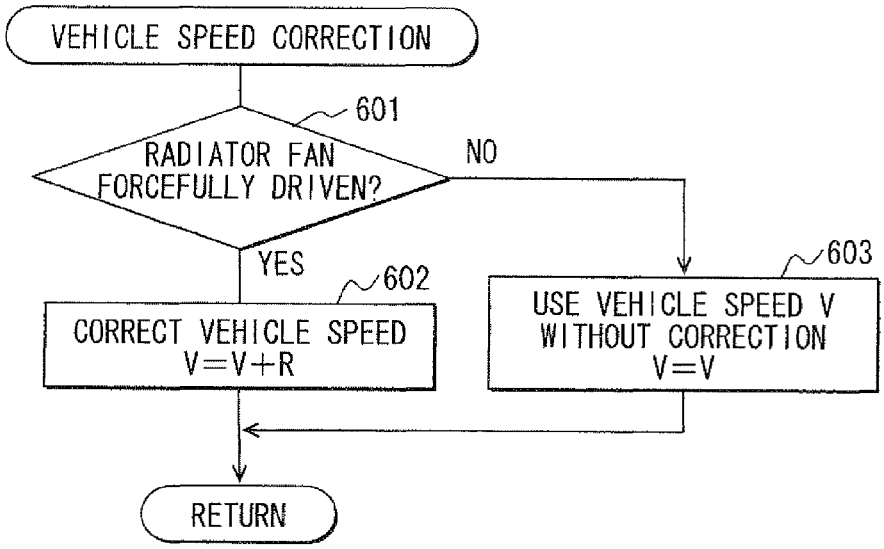
FIG. 8 is a flowchart showing a flow of a vehicle speed correction routine according to the first embodiment.

Thereafter, at step 202, the amount of change cf in the abnormal time coolant temperature corresponding to the current vehicle speed V (the vehicle speed V being corrected through a vehicle speed correction routine shown in FIG. 8) is computed by using the map or equation, which defines the thermostat abnormal time correlation (see FIG. 2). Here, the vehicle speed V is an average vehicle speed per predetermined time period (e.g., per computation cycle of the present routine). Furthermore, the map or equation, which defines the thermostat abnormal time correlation, is formed in advance for each corresponding vehicle based on the design data and/or test data and is stored in the ROM of the ECU 26. Alternatively, the map or equation, which defines the thermostat abnormal time correlation, may be formed and stored for each engine operational condition, and the amount of change cf in the abnormal time coolant temperature may be computed by using the map or equation, which corresponds to the current engine operational condition.

Thereafter, the operation proceeds to step 203. At step 203, the amount of change cf in the abnormal time coolant temperature is corrected based the difference (thw−tha) between the coolant temperature thw and the ambient temperature tha. In this case, for example, the amount of change cf in the abnormal time coolant temperature is corrected such that the amount of change cf in the abnormal time coolant temperature is reduced (i.e., resulting in a decrease in the increasing rate or the increase in the decreasing rate) when the difference (thw−tha) between the coolant temperature thw and the ambient temperature tha is increased.

Thereafter, the operation proceeds to step 204. At step 204, the difference (cf−Δthw) between the amount of change cf in the abnormal time coolant temperature and the amount of change Δthw in the measured coolant temperature is obtained as a correlation value, and this correlation value is added to the previous cumulative correlation value ΣC to obtain the current cumulative correlation value ΣC.

$$\Sigma C = \Sigma C + (cf - \Delta thw)$$

Thereafter, the operation proceeds to step 205 where it is determined whether the cumulative correlation value ΣC is smaller than a predetermined value K. When it is determined that the cumulative correlation value ΣC is smaller than the predetermined value K at step 205, the operation proceeds to step 206. At step 206, it is determined that the thermostat abnormal time correlation exists between the amount of change Δthw in the measured coolant temperature and the vehicle speed V, and thereby a correlation flag XC is set to 1. In such a case, when the determination enabling condition has been previously satisfied at step 104, it is determined that the open state abnormality of the thermostat 19 exists in the first abnormality diagnosis operation.

When it is determined that the cumulative correlation value ΣC is equal to or larger than the predetermined value K at step 205, the operation proceeds to step 207. At step 207, it is determined that the thermostat abnormal time correlation does not exist between the amount of change Δthw in the measured coolant temperature and the vehicle speed V, and thereby the correlation flag XC is set to 0 (zero). In such a case, when the determination enabling condition has been previously satisfied at step 104, it is determined that the open state abnormality of the thermostat 19 does not exist in the first abnormality diagnosis operation.

Now, the coolant temperature estimation routine will be described. The coolant temperature estimation routine of FIG. 5 is a subroutine executed at step 103 of the abnormality diagnosis main routine of FIG. 3 and serves as a coolant temperature estimating means. Upon starting of this routine, at step 301, the amount of increase ΔTup in the coolant temperature caused by the heat generation at the engine 11 is computed using a map or a mathematical equation based on the current engine operational state (e.g., the engine rotational speed, the engine load).

Thereafter, the operation proceeds to step 302. At step 302, the amount of decrease ΔTdown in the coolant temperature caused by the heat release at, for example, the radiator 13 and the heater core 18 is computed based on the current vehicle speed, the coolant temperature and the ambient temperature.

Then, the operation proceeds to step 303. At step 303, the currently estimated coolant temperature T is obtained by adding the difference (ΔTup−ΔTdown) between the amount of increase ΔTup in the coolant temperature and the amount of decrease ΔTdown in the coolant temperature to the previously estimated coolant temperature T.

$$T=T(\Delta T\text{up}-\Delta T\text{down})$$

Now, the normality/abnormality determination routine will be described. The normality/abnormality determination routine shown in FIG. 6 is a subroutine, which is executed at step 105 of the abnormality diagnosis main routine shown in FIG. 3. Upon starting of this routine, at step 401, it is determined whether the measured coolant temperature thw is lower than the determination reference temperature A (e.g., the temperature, which is set to be between the engine start time coolant temperature and the engine warm-up complete state temperature). Then, at step 402, it is determined whether the estimated coolant temperature T is lower than the determination reference temperature B (e.g. the temperature slightly higher than the determination reference temperature A).

When it is determined that the measured coolant temperature thw is equal to or higher than the determination reference temperature A at step 401, it is determined that the measured coolant temperature thw increases in a normal manner. Thereby, in the second abnormality diagnosis operation, it is determined that the open state abnormality of the thermostat 19 does not exist. Therefore, the operation proceeds to step 403. At step 403, it is determined whether the result of the first abnormality diagnosis operation also indicates that the open state abnormality does not exist by checking whether the correlation flag XC is 0 (zero).

When it is determined that the correlation flag XC is 0 (zero), i.e., the result of the first abnormality diagnosis indicates that the open state abnormality of the thermostat 19 does not exist at step 403, the result of the first abnormality diagnosis operation and the result of the second abnormality diagnosis operation are identical to each other. Therefore, the operation proceeds to step 404. At step 404, the common result (identical result) of the first and second abnormality diagnosis operations is adapted as the final abnormality diagnosis result, and it is thereby finally determined that the open state abnormality of the thermostat 19 does not exist (the thermostat 19 being normal). Then, the present routine is terminated.

In contrast, when it is determined that the correlation flag XC is 1, i.e., the result of the first abnormality diagnosis operation indicates that the open state abnormality of the thermostat 19 exists at step 403, the result of the first abnormality diagnosis operation and the result of the second abnormality diagnosis operation are not identical to each other, i.e., are different from each other. Therefore, the operation proceeds to step 407. At step 407, the abnormality diagnosis operation is terminated without finally determining whether the open state abnormality of the thermostat 19 exists.

When it is determined that the estimated coolant temperature T is equal to or higher than the determination reference temperature B at step 402 despite the determination of that the measured coolant temperature thw is lower than the determination reference temperature A at step 401, the measured coolant temperature thw does not increase in a normal manner. Therefore, in the second abnormality diagnosis operation, it is determined that the open state abnormality of the thermostat 19 exists, and the operation proceeds to step 405. At step 405, it is determined whether the correlation flag XC is 1 to determine whether the result of the first abnormality diagnosis operation indicates that the open state abnormality of the thermostat 19 exists.

When it is determined that the correlation flag XC is 1, i.e., the open state abnormality of the thermostat 19 exists in the first abnormality diagnosis operation at step 405, the result of the first abnormality diagnosis operation and the result of the second abnormality diagnosis operation are identical to each other, and the operation proceeds to step 406. At step 406, the common result (identical result) of the first and second abnormality diagnosis operations is adapted as the final abnormality diagnosis result, and it is thereby finally determined that the open state abnormality of the thermostat 19 exists (the thermostat 19 being abnormal). In this case, for example, an abnormality flag is set to an ON state, and a warning lamp 27, which is provided to an instrument panel at a driver's seat side, is lit. Alternatively, a warning is provided to the driver of the vehicle by indicating a warning display on a warning display device (not shown) of the instrument panel at the driver's seat side, and this abnormality information (e.g., an abnormality code) is stored in a rewritable non-volatile memory (a rewritable memory that holds the stored data even when the power supply to the ECU 26 is turned off). Then, the present routine is terminated.

In contrast, when it is determined that the correlation flag XC is 0 (zero), i.e., the result of the first abnormality diagnosis operation indicates that the open state abnormality of the thermostat 19 does not exist at step 405, the result of the first abnormality diagnosis operation and the result of the second abnormality diagnosis operation are not identical to each other. Therefore, the operation proceeds to step 407. At step 407, the abnormality diagnosis operation is terminated without finally determining whether the open state abnormality of the thermostat 19 exists.

Figure 7:
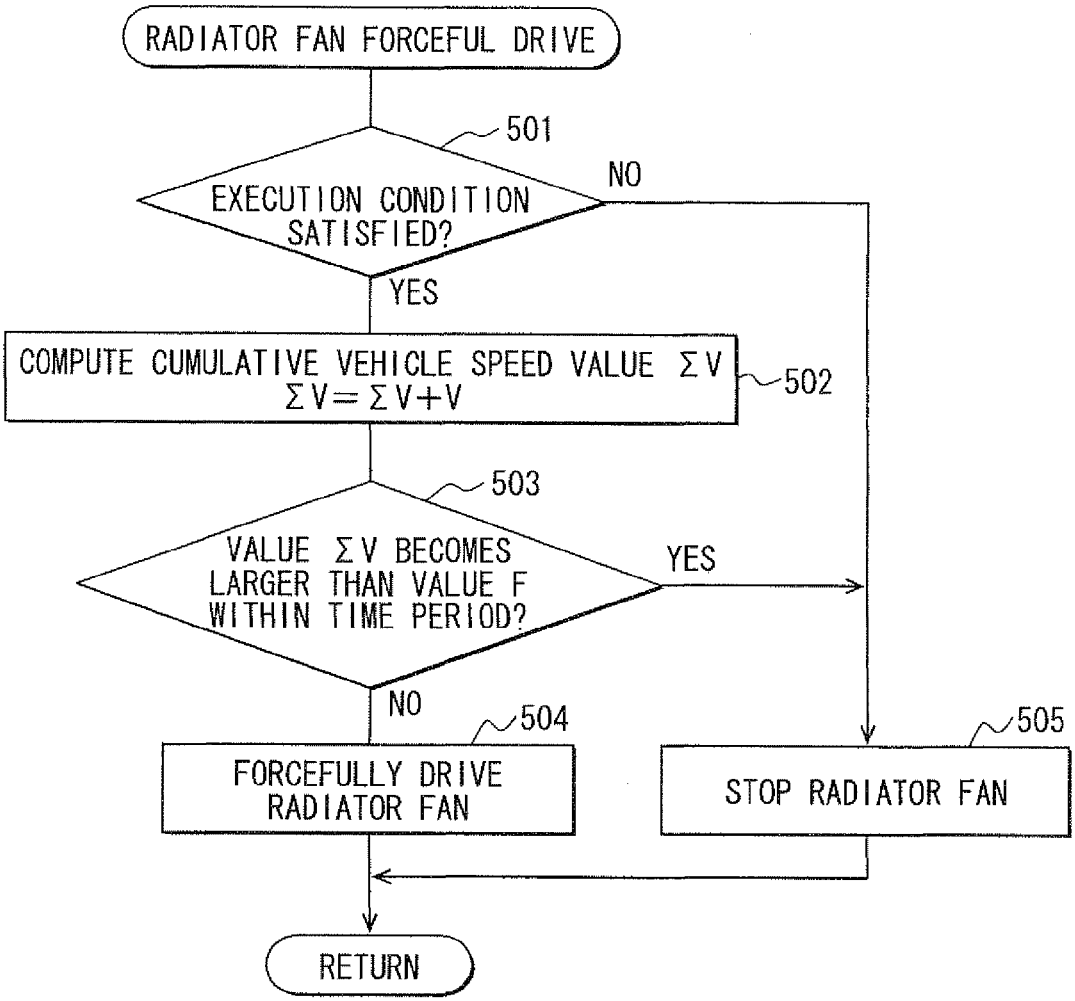
FIG. 7 is a flowchart showing a flow of a radiator fan forceful drive routine according to the first embodiment.

Now, the radiator fan forceful drive routine will be described. The radiator fan forceful drive routine shown in FIG. 7 is executed at predetermined intervals while the power supply to the ECU 26 is turned on. Upon starting of this routine, at step 501, it is determined whether the abnormality diagnosis execution condition, which is the same as that of step 101 of FIG. 3, is satisfied. When it is determined that the predetermined abnormality diagnosis execution condition is not satisfied at step 501, the operation proceeds to step 505 where the stop state of the radiator fan 21 is maintained.

In contrast, when it is determined that the abnormality diagnosis execution condition is satisfied at step 501, it is determined that the abnormality diagnosis operation of the thermostat 19 is still executed. Thereby, the operation proceeds to step 502 where the currently measured vehicle speed V, which is measured with the vehicle speed sensor 25, is added to the previous cumulative vehicle speed value ΣV, to renew the cumulative vehicle speed value ΣV.

$$\Sigma V=\Sigma V+V$$

Thereafter, the operation proceeds to step 503. At step 503, it is determined whether the cumulative vehicle speed value ΣV has become larger than a predetermined value F within a predetermined time period since the time of starting the cumulation of the vehicle speed V during the period of executing the abnormality diagnosis operation. When it is determined that the cumulative vehicle speed value ΣV has become larger than the predetermined value F within the predetermined time period at step 503, it is determined that the amount of air flow, which is generated by the forward movement of the vehicle and is applied to the radiator 13, is small. Therefore, the operation proceeds to step 504 where the radiator fan 21 is forcefully driven. In this way, the amount of air flow, which is applied to the radiator 13, is reliably increased with the aid of the air flow created by the radiator fan 21, In contrast, when it is determined that the cumulative vehicle speed value ΣV has not become larger that the predetermined value F within the predetermined time period at step 503, it is determined that the vehicle speed has become sufficiently high during the period of executing the abnormality diagnosis operation, and thereby the amount of air flow, which is generated by the forward movement of the vehicle and is applied to the radiator 13, is sufficiently large. Thereby, the operation proceeds to step 505 where the stop state of the radiator fan 21 is maintained.

Now, the vehicle speed correction routine will be described. The vehicle speed correction routine shown in FIG. 8 is executed at predetermined intervals while the power supply to the ECU 26 is turned on. Upon starting of this routine, at step 601, it is determined whether the radiator fan 21 is currently forcefully driven. When it is determined that the radiator fan 21 is currently forcefully driven at step 601, the operation proceeds to step 602. At step 602, a correction value R is added to the vehicle speed V, which is measured with the vehicle speed sensor 25, to correct the vehicle speed V. This corrected vehicle speed V is then used as the vehicle speed in the abnormality diagnosis operation (the routine of FIG. 4 discussed above).

$$V=V+R$$

Here, the correction value R is a value that corresponds to a required vehicle speed, which is required to generate the air flow by the forward movement of the vehicle in the amount that is equal to the amount of air flow otherwise generated by the radiator fan 21. The correction value R is set according to the drive state of the radiator fan 21 (e.g., the rotational speed, the drive voltage). When the operational state of the radiator fan 21 at the time of the forceful drive operation of the radiator fan 21 is constant for each time, the correction value R may be a fixed constant value.

When it is determined that the radiator fan 21 is not currently forcefully driven at step 601, the operation proceeds to step 603. At step 603, the vehicle speed V, which is measured with the vehicle speed sensor 25, is not corrected and is directly used in the abnormality diagnosis operation.

According to the first embodiment, in the warm-up incomplete temperature range that is lower than the predetermined coolant temperature, the amount of change cf in the abnormal time coolant temperature corresponding to the vehicle speed V is computed through use of the thermostat abnormal time correlation. Then, the difference (cf−Δthw) between the amount of change cf in the abnormal time coolant temperature and the amount of change Δthw in the measured coolant temperature is computed as the correlation value. This correlation value (cf−Δthw) is evaluated to determine whether the thermostat abnormal time correlation exists between the amount of change Δthw in the measured coolant temperature and the vehicle speed V. In this way, it is possible to accurately sense the open state abnormality of the thermostat 19 through use of the thermostat abnormal time correlation.

According to the first embodiment, the amount of change cf in the abnormal time coolant temperature is corrected based on the difference (thw−tha) between the coolant temperature thw and the ambient temperature tha. Therefore, it is possible to accurately determine the correlation between the amount of change Δthw in the measured coolant temperature and the vehicle speed V in view of the influence of the ambient temperature.

Furthermore, according to the first embodiment, in the case where the cumulative vehicle speed value ΣV does not exceed the predetermined value F within the predetermined time period during the abnormality diagnosis operation period, it is determined that the amount of air flow, which is generated by the forward movement of the vehicle and is applied to the radiator 13, is small due to the low vehicle speed, and thereby the radiator fan 21 is forcefully driven. In this way, the amount of air flow, which is applied to the radiator 13, is reliably increased by the air flow generated by the radiator fan 21. Furthermore, the vehicle speed is corrected according to the operational state of the radiator fan 21, so that the influences of the air flow generated by the radiator fan 21 can be reflected on the vehicle speed. In this way, even in the case where the amount of air flow, which is generated by the forward movement of the vehicle and is applied to the radiator 13, is small, it is possible to accurately determine whether the thermostat abnormal time correlation exists between the amount of change Δthw in the measured coolant temperature and the vehicle speed V.

Furthermore, according to the first embodiment, the first abnormality diagnosis operation is executed to determine whether the thermostat open state abnormality exists based on whether the thermostat abnormal time correlation exists between the amount of change Δthw in the measured coolant temperature and the vehicle speed V. Also, the second abnormality diagnosis operation is executed to determine whether the thermostat open state abnormality exists based on the measured coolant temperature and the estimated coolant temperature. When the result of the first abnormality diagnosis operation and the result of the second abnormality diagnosis operation are identical to each other, this identical abnormality diagnosis result is used as the final abnormality diagnosis result. In this way, it is possible to further improve the accuracy of the abnormality diagnosis of the thermostat 19.

Furthermore, according to the first embodiment, the amount of change cf in the abnormal time coolant temperature is corrected based on the difference (thw−tha) between the coolant temperature thw and the ambient temperature tha. Alternatively, the amount of change Δthw in the measured coolant temperature may be corrected based on the difference (thw−tha) between the coolant temperature thw and the ambient temperature tha.

Second Embodiment

A second embodiment of the present invention will be described with reference to FIG. 9. In the following description, components as well as steps similar to those of the first embodiment will not be described for the sake of the simplicity, and differences, which are different from those of the first embodiment, will be mainly discussed below.

Figure 9:
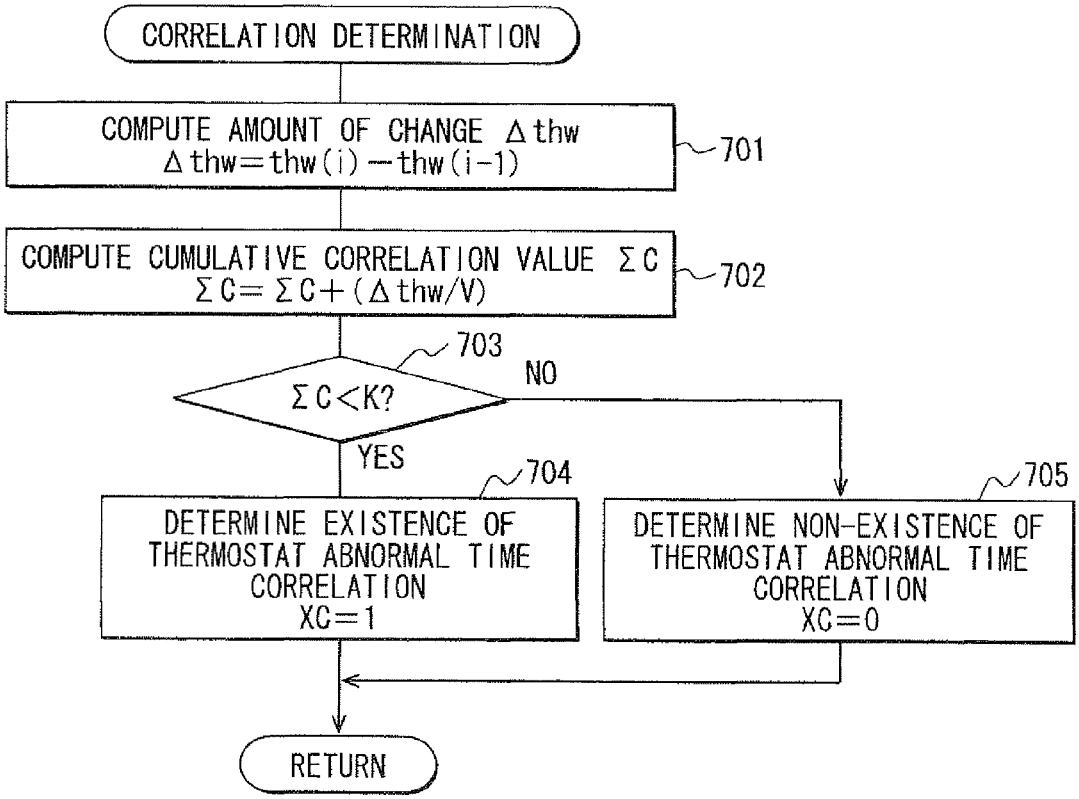
FIG. 9 is a flowchart showing a flow of a correlation determination routine according to a second embodiment of the present invention.

According to the second embodiment, the correlation determination routine of FIG. 9 is executed by the ECU 26, so that a ratio (Δthw/V) between the amount of change Δthw in the measured coolant temperature and the vehicle speed V is computed as a correlation value. Then, this correlation value is evaluated to determine whether the thermostat abnormal time correlation exists between the amount of change Δthw in the measured coolant temperature and the vehicle speed V. When the correlation between the amount of change Δthw in the measured coolant temperature and the vehicle speed V becomes closer to the thermostat abnormal time correlation, the ratio (Δthw/V) between the amount of change Δthw in the measured coolant temperature and the vehicle speed V becomes closer to a predetermined value (a ratio between the amount of change Δthw in the measured coolant temperature at the thermostat abnormal time and the vehicle speed V). Therefore, when the ratio (Δthw/V) between the amount of change Δthw in the measured coolant temperature and the vehicle speed V is evaluated as the correlation value, it is possible to accurately determine whether the thermostat abnormal time correlation exists between the amount of change Δthw in the measured coolant temperature and the vehicle speed V.

In the correlation routine shown in FIG. 9, at step 701, the amount of change Δthw in the measured coolant temperature is computed. Here, the amount of change Δthw in the measured coolant temperature may be corrected based on the difference (thw−tha) between the coolant temperature thw and the ambient temperature tha.

Thereafter, the operation proceeds to step 702 where the ratio (Δthw/V) between the amount of change Δthw in the measured coolant temperature and the vehicle speed V is computed as a correlation value. Then, this correlation value (Δthw/V) is added to the previous cumulative correction value ΣC to updated the cumulative correlation value ΣC.

$$\Sigma C=\Sigma C+(\Delta thw/V)$$

Thereafter, the operation proceeds to step 703 where it is determined whether the cumulative correlation value ΣC is smaller than a predetermined value K. When it is determined that the cumulative correlation value ΣC is smaller than the predetermined value K at step 703, the operation proceeds to step 704. At step 704, it is determined that the thermostat abnormal time correlation exists between the amount of change Δthw in the measured coolant temperature and the vehicle speed V, and thereby the correlation flag XC is set to 1.

When it is determined that the cumulative correlation value ΣC is equal to or larger than the predetermined value K at step 703, the operation proceeds to step 705. At step 705, it is determined that the thermostat abnormal time correlation does not exist between the amount of change Δthw in the measured coolant temperature and the vehicle speed V, and thereby the correlation flag XC is set to 0 (zero).

Even in the second embodiment, the advantages similar to those of the first embodiment can be achieved.

Third Embodiment

A third embodiment of the present invention will be described with reference to FIG. 10. In the following description, components as well as steps similar to those of the first embodiment will not be described for the sake of the simplicity, and differences, which are different from those of the first embodiment, will be mainly discussed below.

The amount of change Δthw in the measured coolant temperature, which is measured with the coolant temperature sensor 20, can be obtained according to the following equation (1) based on the amount of change Δthw1 in the coolant temperature caused by the application of heat from the engine 11 to the coolant, the amount of change (−Δthw2) in the coolant temperature caused by the release of heat from the coolant through the radiator 13, the amount of change (−Δthw3) in the coolant temperature caused by the release of heat from the coolant through the heater core 18, and the amount of change (−Δthw4) in the coolant temperature caused by the release of heat from the coolant through the component(s) or part(s) of the coolant circuit 16 (e.g., coolant circulation pipe) other than the radiator 13 and the heater core 18.

$$\Delta thw=\Delta thw1-\Delta thw2-\Delta thw3-\Delta thw4 \qquad \text{Equation (1)}$$

When the above equation (1) is solved for the amount of change (−Δthw2) in the coolant temperature caused by the release of heat from the coolant through the radiator 13, the following equation (2) can be obtained.

$$-\Delta thw2=\Delta thw-\Delta thw1-(-\Delta thw3-thw4) \qquad \text{Equation (2)}$$

It is possible to obtain the amount of change (−Δthw2) in the coolant temperature caused by the release of heat from the coolant through the radiator 13 based on the above equation (2).

When the open state abnormality of the thermostat 19 occurs, the following relationship is established between the amount of change (−Δthw2) in the coolant temperature caused by the release of heat from the coolant through the radiator 13 and the vehicle speed V. That is, when the vehicle speed is increased, the amount of change in the coolant temperature caused by the release of heat from the coolant through the radiator 13 is reduced (resulting in an increase in the decreasing rate).

Therefore, according to the third embodiment, a correlation determination routine of FIG. 10 described below is executed by the ECU 26. Thereby, based on the equation (2) discussed above, the amount of change (−Δthw2) in the coolant temperature caused by the release of heat from the coolant through the radiator 13 is computed as the radiator side released heat amount information. Then, it is determined whether the predetermined thermostat abnormal time correlation (see FIG. 2) exists between the amount of change (−Δthw2) in the coolant temperature caused by the release of heat from the coolant through the radiator 13 and the vehicle speed V. In this way, it is determined whether the thermostat open state abnormality exists.

Figure 10:
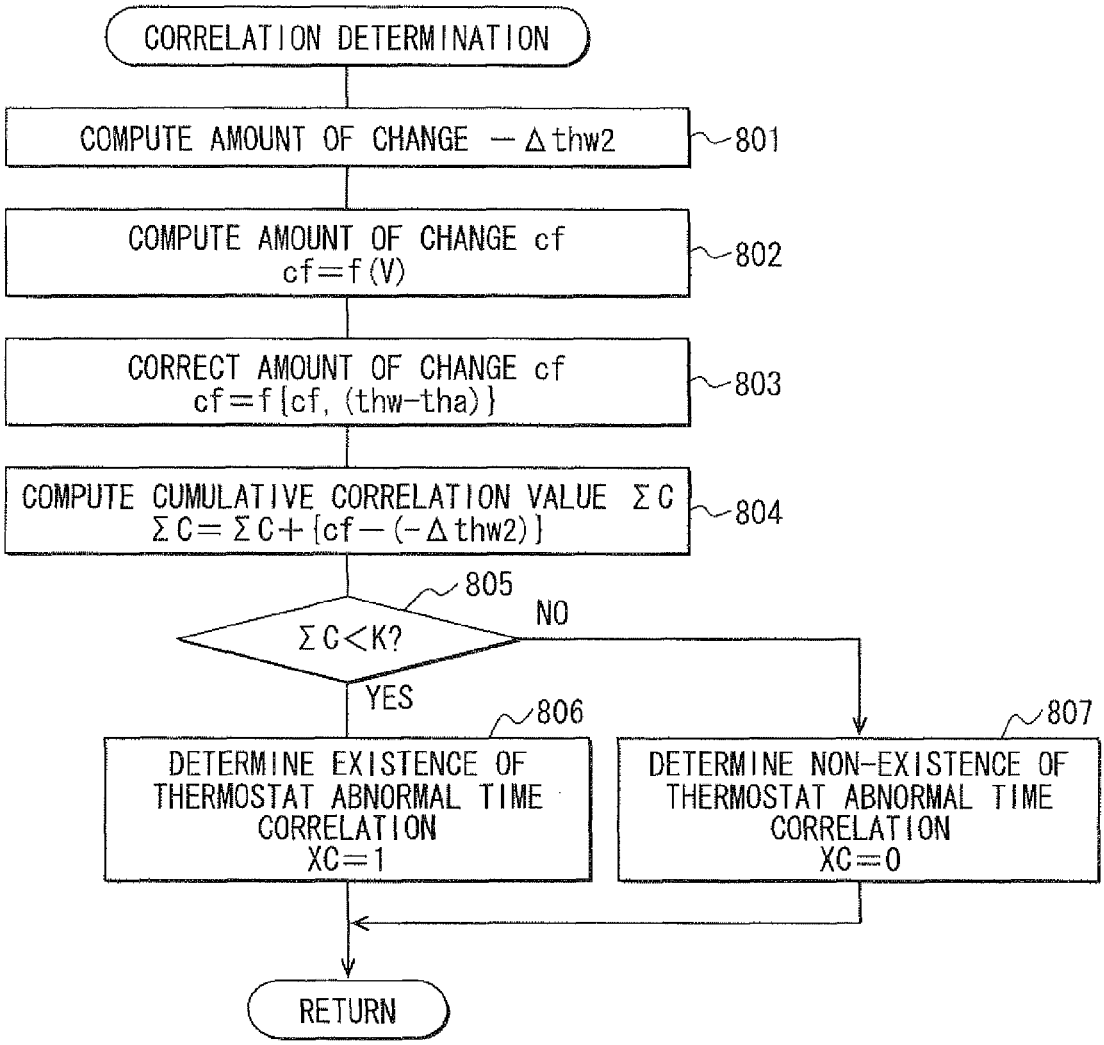
FIG. 10 is a flowchart showing a flow of a correlation determination routine according to a third embodiment of the present invention.

In the correlation determination routine of FIG. 10, at step 801, the amount of change (−Δthw2) in the coolant temperature caused by the release of heat from the coolant through the radiator 13 is computed through use of the equation (2) based on the the amount of change Δthw in the measured coolant temperature, which is measured with the coolant temperature sensor 20, the amount of change Δthw1 in the coolant temperature caused by the application of heat from the engine 11 to the coolant, the amount of change (−Δthw3) in the coolant temperature caused by the release of heat from the coolant through the heater core 18, and the amount of change (−Δthw4) in the coolant temperature caused by the release of heat from the coolant through the component(s) or part(s) of the coolant circuit 16 (e.g., the coolant circulation pipe) other than the radiator 13 and the heater core 18.

Thereafter, the operation proceeds to step 802. At step 802, the amount of change cf in the abnormal time coolant temperature caused by the release of heat from the coolant through the radiator 13 corresponding to the current vehicle speed V is computed through use of a map or a mathematical equation, which defines the thermostat abnormal time correlation (see FIG. 2). Thereafter, the operation proceeds to step 803. At step 803, the amount of change cf in the abnormal time coolant temperature caused by the release of heat from the coolant through the radiator 13 is corrected based on the difference (thw−tha) between the coolant temperature thw and the ambient temperature tha.

Thereafter, the operation proceeds to step 804. At step 804, the difference [cf−(−Δthw2)] between the amount of change cf in the abnormal time coolant temperature caused by the release of heat from the coolant through the radiator 13 and the amount of change (−Δthw2) in the coolant temperature caused by the release of heat from the coolant through the radiator 13 is computed as a correlation value. This correlation value [cf−(−Δthw2)] is added to the previous cumulative correlation value ΣC to update the cumulative correlation value ΣC.

$$\Sigma C=\Sigma C+[cf-(-\Delta thw2)]$$

Thereafter, the operation proceeds to step 805 where it is determined whether the cumulative correlation value ΣC is smaller than the predetermined value K. When it is determined that the cumulative correlation value ΣC is smaller than the predetermined value K at step 805, the operation proceeds to step 806. At step 806, it is determined that the thermostat abnormal time correlation exists between the amount of change (−Δthw2) in the coolant temperature caused by the release of heat from the coolant through the radiator 13 and the vehicle speed V, and thereby the correlation flag XC is set to 1.

In contrast, when it is determined that the cumulative correlation value ΣC is equal to or larger than the predetermined value K at step 805, the operation proceeds to step 807. At step 807, it is determined that the thermostat abnormal time correlation does not exist between the amount of change (−Δthw2) in the coolant temperature caused by the release of heat from the coolant through the radiator 13 and the vehicle speed V, and thereby the correlation flag XC is set to 0 (zero).

According to the third embodiment, the amount of change (−Δthw2) in the coolant temperature caused by the release of heat from the coolant through the radiator 13 is computed based on the amount of change Δthw in the measured coolant temperature, which is measured with the coolant temperature sensor 20, the amount of change Δthw1 in the coolant temperature caused by the application of heat from the engine 11 to the coolant, the amount of change (−Δthw3) in the coolant temperature caused by the release of heat from the coolant through the heater core 18, and the amount of change (−Δthw4) in the coolant temperature caused by the release of heat from the coolant through the component(s) or part(s) of the coolant circuit 16 (e.g., coolant circulation pipe) other than the radiator 13 and the heater core 18. Therefore, the amount of change (−Δthw2) in the coolant temperature caused by the release of heat from the coolant through the radiator 13 can be accurately computed. Then, this accurately computed amount of change (−Δthw2) in the coolant temperature caused by the release of heat from the coolant through the radiator 13 is used to determine whether the thermostat abnormal time correlation exists between the amount of change (−Δthw2) in the coolant temperature caused by the release of heat from the coolant through the radiator 13 and the vehicle speed V. Therefore, the abnormality detection of the thermostat 19 can be more accurately performed.

In the third embodiment, the difference [cf−(−Δthw2)] between the amount of change cf in the abnormal time coolant temperature caused by the release of heat from the coolant through the radiator 13 and the amount of change (−Δthw2) in the coolant temperature caused by the release of heat from the coolant through the radiator 13 is computed as the correlation value. Then, this correlation value [cf−(−Δthw2)] is evaluated to determine whether the thermostat abnormal time correlation exists between the amount of change (−Δthw2) in the coolant temperature caused by the release of heat from the coolant through the radiator 13 and the vehicle speed V. Alternatively, a ratio (−Δthw2/V) between the amount of change (−Δthw2) in the coolant temperature caused by the release of heat from the coolant through the radiator 13 and the vehicle speed V may be computed as a correlation value. Then, this correlation value (−Δthw2/V) may be evaluated to determine whether the thermostat abnormal time correlation exists between the amount of change (−Δthw2) in the coolant temperature caused by the release of heat from the coolant through the radiator 13 and the vehicle speed V.

Furthermore, the amount of change (−Δthw2) in the coolant temperature caused by the release of heat from the coolant through the radiator 13 may be corrected based on the difference (thw−tha) between the coolant temperature thw and the ambient temperature tha.

Fourth Embodiment

A fourth embodiment of the present invention will be described with reference to FIG. 11. In the following description, components as well as steps similar to those of the first embodiment will not be described for the sake of the simplicity, and differences, which are different from those of the first embodiment, will be mainly discussed below.

In each of the first to third embodiments, when the result of the first abnormality diagnosis operation and the result of the second abnormality diagnosis operation are identical to each other, this identical abnormality diagnosis result is used as the final abnormality diagnosis result. Contrary to this, according to the fourth embodiment, a normality/abnormality determination routine of FIG. 11 discussed later is executed by the ECU 26 to use one of the result of the first abnormality diagnosis operation and the result of the second abnormality diagnosis operation, which is completed earlier than the other one, as the final abnormality diagnosis result. Furthermore, in the normality/abnormality determination routine of FIG. 11, step 104 of the abnormality diagnosis main routine of FIG. 3 is eliminated.

Figure 11:
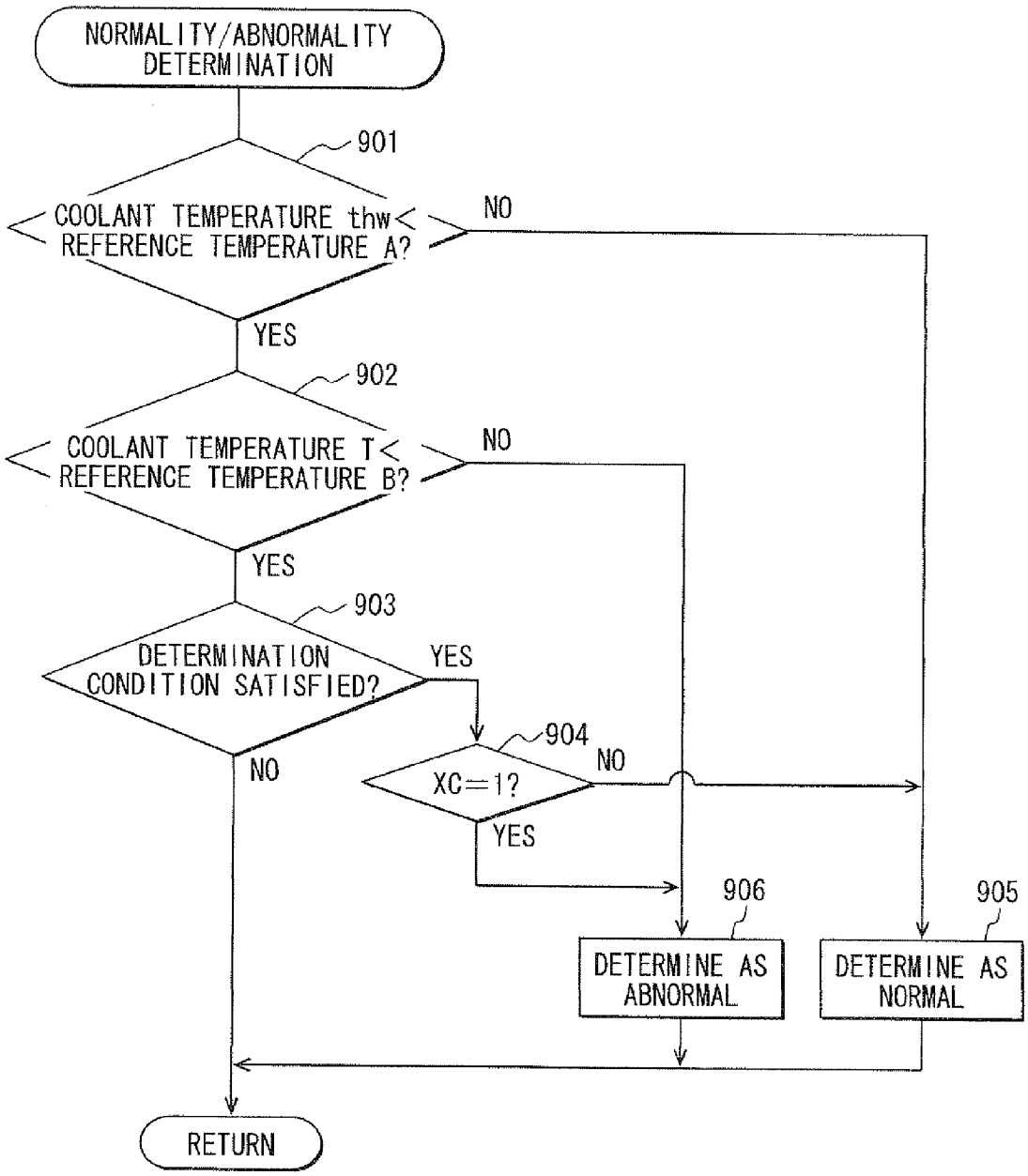
FIG. 11 is a flowchart showing a flow of a normality/abnormality determination routine according to a fourth embodiment of the present invention.

In the normality/abnormality determination routine of FIG. 11, at step 901, it is determined wither the measured coolant temperature thw is lower than the determination reference temperature A. Then, at step 902, it is determined whether the estimated coolant temperature T is lower than the determination reference temperature B.

When it is determined that the measured coolant temperature thw is equal to or higher than the determination reference temperature A at step 901, the measured coolant temperature thw is increased in a normal manner. Therefore, it is determined that the open state abnormality of the thermostat 19 does not exist. Then, the operation proceeds to step 905 where it is finally determined that the open state abnormality of the thermostat 19 does not exist (the thermostat 19 being normal).

When it is determined that the estimated coolant temperature T is equal to or higher than the determination reference temperature B at step 902 after the determination of that the measured coolant temperature thw is lower than the determination reference temperature A at step 901, the measured coolant temperature thw is not increased in a normal manner. Therefore, it is determined that the open state abnormality of the thermostat 19 exists in the second abnormality diagnosis operation. Then, the operation proceeds to step 906, and it is finally determined that the open state abnormality of the thermostat 19 exists.

When it is determined that the estimated coolant temperature T is lower than the determination reference temperature B at step 902 after the determination of that the measured coolant temperature thw is lower than the determination reference temperature A at step 901, it is determined that the second abnormality diagnosis operation has not been completed. Thereby, the operation proceeds to step 903 where it is determined whether the predetermined correlation determination condition is satisfied. For example, this may be determined by determining whether the cumulative value of the measured vehicle speeds, which have been cumulated since the time of satisfying the abnormality execution condition, has become larger than a predetermined value. The correlation determination condition may be satisfied, for example, when the number of times of executing the computation of the correlation value is larger than a corresponding predetermined number, or when an average of the measured vehicle speeds is larger than a corresponding predetermined value.

When it is determined that the correlation determination condition is satisfied at step 903, it is determined that the correlation between the radiator side released heat amount information (the amount of change in the measured coolant temperature or the amount of change in the coolant temperature caused by the release of heat from the coolant through the radiator 13) and the vehicle speed can be accurately determined. Therefore, the operation proceeds to step 904. At step 904, it is determined whether the result of the first abnormality diagnosis operation indicates the existence of the open state abnormality of the thermostat 19 based on the presence of the state of the correlation flag XC=1.

When it is determined that the correlation flag XC is 0 (zero) at step 904, i.e., when it is determined that the open state abnormality of the thermostat 19 does not exist in the first abnormality diagnosis operation, the operation proceeds to step 905. At step 905, it is finally determined that the open state abnormality of the thermostat 19 does not exist (the thermostat 19 being normal).

In contrast, when it is determined that the correlation flag XC is 1 at step 904, i.e., when it is determined that the open state abnormality of the thermostat 19 exists in the first abnormality diagnosis operation, the operation proceeds to step 906. At step 906, it is finally determined that the open state abnormality of the thermostat 19 exists.

In the above described manner, the one of the result of the first abnormality diagnosis operation and the result of the second abnormality diagnosis operation, which is completed earlier than the other one, is used as the final abnormality diagnosis result. Therefore, it is possible to confirm the result of the abnormality diagnosis of the thermostat 19 in the early stage.

Fifth Embodiment

A fifth embodiment of the present invention will be described with reference to FIG. 12. In the following description, components as well as steps similar to those of the first embodiment will not be described for the sake of the simplicity, and differences, which are different from those of the first embodiment, will be mainly discussed below.

Figure 12:
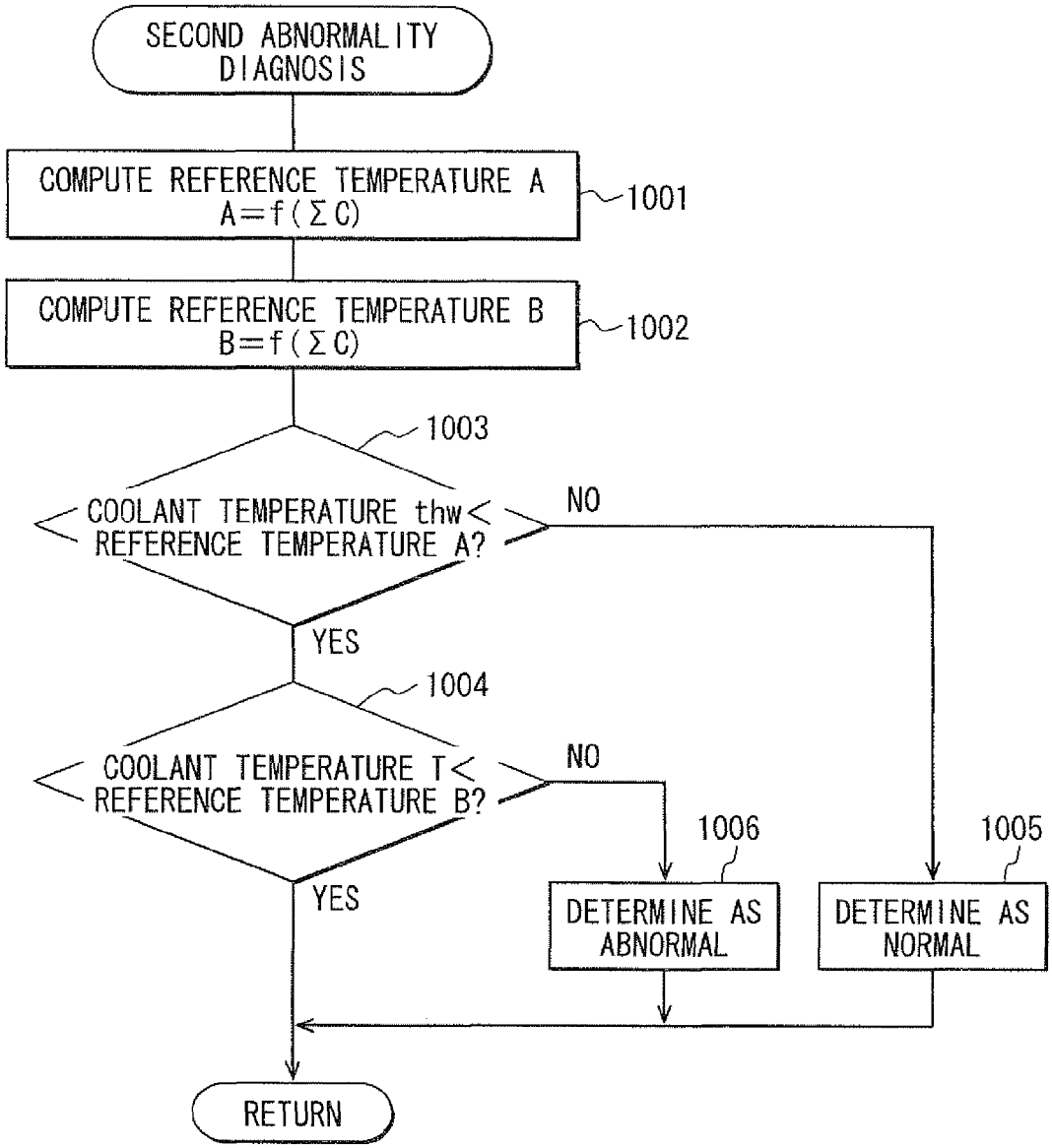
FIG. 12 is a flowchart showing a flow of a second abnormality diagnosis routine according to a fifth embodiment of the present invention.

According to the fifth embodiment, the ECU 26 executes a second abnormality diagnosis routine of FIG. 12 to change the determination condition (e.g., the determination reference value or temperature), which is used to determine whether the open state abnormality of the thermostat exists in the second abnormality diagnosis operation according to the cumulative correlation value ΣC, which is computed to determine the correlation between the radiator side released heat amount information (the amount of change in the measured coolant temperature or the amount of change in the coolant temperature caused by the release of heat from the coolant through the radiator 13) and the vehicle speed in the first abnormality diagnosis operation.

In the second abnormality diagnosis routine of FIG. 12, at step 1001, the determination reference temperature A of the measured coolant temperature thw is computed through use of a map or a mathematical equation based on the cumulative correlation value ΣC, which is computed in the first abnormality diagnosis operation. The map or the mathematical equation, which is used to compute the determination reference temperature A, is set such that the determination reference temperature A is increased when the cumulative correlation value ΣC is increased, i.e., when the deviation of the correlation between the radiator side released heat amount information and the vehicle speed from the thermostat abnormal time correlation is increased.

Thereafter, the operation proceeds to step 1002. At step 1002, the determination reference temperature B of the estimated coolant temperature T is computed through use of a map or a mathematical equation based on the cumulative correlation value ΣC, which is computed in the first abnormality diagnosis operation. The map or the mathematical equation, which is used to compute the determination reference temperature B, is set such that the determination reference temperature B is increased when the cumulative correlation value ΣC is increased.

Thereafter, at step 1003, it is determined whether the measured coolant temperature thw is lower than the determination reference temperature A. Then, at step 1004, it is determined whether the estimated coolant temperature T is lower than the determination reference temperature B.

When it is determined that the measured coolant temperature thw is equal to or higher than the determination reference temperature A at step 1003, the measured coolant temperature thw is increased in the normal manner. Therefore, it is determined that the open state abnormality of the thermostat 19 does not exist (the thermostat 19 being normal). Then, the operation proceeds to step 1005 where it is finally determined that the open state abnormality of the thermostat 19 does not exist (the thermostat 19 being normal).

In contrast, when it is determined that the estimated coolant temperature T is equal to or higher than the determination reference temperature B at step 1004 after the determination of that the measured coolant temperature thw is lower than the determination reference temperature A at step 1003, the measured coolant temperature thw is not increased in a normal manner. Therefore, the operation proceeds to step 1006, and it is finally determined that the open state abnormality of the thermostat 19 exists.

In the fifth embodiment, the determination reference temperatures, which are used to determine whether the thermostat open state abnormality exists in the second abnormality diagnosis operation, are changed based on the cumulative correlation value ΣC, which is computed to determine the correlation between the radiator side released heat amount information and the vehicle speed in the first abnormality diagnosis operation. In this way, it is possible to further improve the accuracy of the abnormality diagnosis in the second abnormality diagnosis operation by appropriately changing the determination reference temperatures of the second abnormality diagnosis operation based on the cumulative correlation value ΣC (the degree of correlation between the radiator side released heat amount information and the vehicle speed), which is computed in the first abnormality diagnosis operation.

In the fifth embodiment, the determination reference temperatures, which are used in the second abnormality diagnosis operation, are changed based on the cumulative correlation value ΣC. Alternatively, the measured coolant temperature thw and the estimated coolant temperature T, which are used in the second abnormality diagnosis operation, may be corrected based on the cumulative correlation value ΣC.

Furthermore, in each of the first to fifth embodiments, the cumulative correlation value (the cumulative value of the correlation values) is used as the determination parameter, which is used to determine the correlation between the radiator side released heat amount information (the amount of change in the measured coolant temperature or the amount of change in the coolant temperature caused by the release of heat from the coolant through the radiator 13) and the vehicle speed in the first abnormality diagnosis operation. However, the present invention is not limited to this. For example, an average correlation value (an average value of the correlation values) or the correlation value may be used as the determination parameter.

In each of the first to fifth embodiments, when the cumulative vehicle speed value ΣV has not become larger than the predetermined value F within the predetermined time period during the period of executing the abnormality diagnosis operation, the radiator fan 21 is forcefully driven. Alternatively, the radiator 21 may be always forcefully driven during the period of executing the abnormality diagnosis operation.

In each of the first to fifth embodiments, the amount of change in the measured coolant temperature or the amount of change in the coolant temperature caused by the release of heat from the coolant through the radiator 13 is used as the radiator side released heat amount information. However, the present invention is not limited to this. For example, the released heat amount of the radiator 13 may be used as the radiator side released heat amount information.

In each of the first to fifth embodiments, the first abnormality diagnosis operation (the abnormality diagnosis operation using the thermostat abnormal time correlation) and the second abnormality diagnosis operation (the abnormality diagnosis operation using the estimated coolant temperature) are executed. Alternatively, only the first abnormality diagnosis operation may be performed.

Furthermore, the present invention may be modified in any other appropriate manner. For example, the location of the thermostat 19, which is provided in the coolant circuit 16, may be modified to another location. Also, the construction of the engine cooling system may be modified into an appropriate manner. That is, the present invention may be applied to various engine cooling systems as long as the engine cooling systems have the thermostat in the coolant circuit, which circulates the coolant between the engine and the radiator.

Additional advantages and modifications will readily occur to those skilled in the art. The invention in its broader terms is therefore not limited to the specific details, representative apparatus, and illustrative examples shown and described.

What is claimed is:

1. An abnormality diagnosis apparatus for a cooling system of a vehicle, which includes a coolant circuit that circulates coolant between an internal combustion engine and a radiator of the vehicle and is provided with a thermostat, wherein the thermostat is closed in a predetermined warm-up incomplete temperature range of the coolant, in which warm-up of the internal combustion engine is determined to be incomplete, to stop the circulation of the coolant between the internal combustion engine and the radiator, the abnormality diagnosis apparatus comprising:

a radiator side released heat amount information obtaining means for obtaining radiator side released heat amount information, which indicates an amount of heat released from the coolant through the radiator or information relevant to the amount of heat released from the coolant through the radiator; and an abnormality diagnosis means for determining whether a thermostat open state abnormality, which is an abnormality of the thermostat that disables closing of the thermostat in the warm-up incomplete temperature range of the coolant and thereby leaves the thermostat opened in the warm-up incomplete temperature range of the coolant, exists by determining whether a predetermined thermostat abnormal time correlation exists between the radiator side released heat amount information and a vehicle speed of the vehicle in the warm-up incomplete temperature range of the coolant.

2. The abnormality diagnosis apparatus according to claim 1, further comprising a coolant temperature sensor that measures a coolant temperature of the coolant on an internal combustion engine side of the thermostat in the coolant circuit, wherein the radiator side released heat amount information obtaining means obtains an amount of change in the measured coolant temperature, which is measured with the coolant temperature sensor, as the radiator side released heat amount information.

3. The abnormality diagnosis apparatus according to claim 1, further comprising a coolant temperature sensor that measures a coolant temperature of the coolant on an internal combustion engine side of the thermostat in the coolant circuit, wherein:

the radiator side released heat amount information obtaining means includes a means for estimating an amount of change in the coolant temperature caused by release of heat from the radiator based on:

an amount of change in the measured coolant temperature, which is measured with the coolant temperature sensor;

an amount of change in the coolant temperature caused by application of heat received from the internal combustion engine; and an amount of change in the coolant temperature caused by release of heat from the coolant through at least one remaining part of the coolant circuit, which is other than the radiator; and the radiator side released heat amount information obtaining means uses the amount of change in the coolant temperature caused by release of heat from the coolant through the radiator as the radiator side released heat amount information.

4. The abnormality diagnosis apparatus according to claim 1, wherein the thermostat abnormal time correlation is set such that when the vehicle speed is increased, the radiator side released heat amount information changes in a manner that increases the amount of heat released from the coolant through the radiator.

5. The abnormality diagnosis apparatus according to claim 1, wherein the abnormality diagnosis means includes:

a means for computing abnormal time radiator side released heat amount information, which indicates an amount of heat released from the coolant through the radiator at abnormal time or information relevant to the amount of heat released from the coolant through the radiator at the abnormal time, based on the vehicle speed through use of the thermostat abnormal time correlation; and a means for computing a difference between the abnormal time radiator side released heat amount information and the radiator side released heat amount information as a correlation value; and the abnormality diagnosis means determines whether the thermostat abnormal time correlation exists between the radiator side released heat amount information and the vehicle speed by evaluating the correlation value.

6. The abnormality diagnosis apparatus according to claim 1, wherein:

the abnormality diagnosis means includes a means for computing a ratio between the radiator side released heat amount information and the vehicle speed as a correlation value; and the abnormality diagnosis means determines whether the thermostat abnormal time correlation exists between the radiator side released heat amount information and the vehicle speed by evaluating the correlation value.

7. The abnormality diagnosis apparatus according to claim 1, wherein:

the abnormality diagnosis means computes a correlation value, which is used to determine a correlation between the radiator side released heat amount information and the vehicle speed, for multiple times to provide a plurality of correlation values; and the abnormality diagnosis means determines whether the thermostat abnormal time correlation exists between the radiator side released heat amount information and the vehicle speed through use of a cumulative value of the plurality of correlation values or an average value of the plurality of correlation values.

8. The abnormality diagnosis apparatus according to claim 7, wherein the abnormality diagnosis means includes a means for prohibiting execution of determining whether the thermostat open state abnormality exists until at least one of a number of times of executing the computation of the correlation value, the cumulative value of the vehicle speeds and an average value of the vehicle speeds becomes larger than a corresponding predetermined value.

9. The abnormality diagnosis apparatus according to claim 1, wherein the abnormality diagnosis means includes a means for correcting the radiator side released heat amount information based on a difference between the coolant temperature and an ambient temperature at outside of the cooling system.

10. The abnormality diagnosis apparatus according to claim 5, wherein the abnormality diagnosis means includes a means for correcting the abnormal time radiator side released heat amount information based on a difference between the coolant temperature and an ambient temperature at outside of the cooling system.

11. The abnormality diagnosis apparatus according to claim 1, further comprising a radiator fan, which generates a cooling air flow that is applied to the radiator, wherein the abnormality diagnosis means forcefully drives the radiator fan during a predetermined abnormality diagnosis period and includes a means for correcting the vehicle speed, which is used to determine the correlation between the radiator side released heat amount information and the vehicle speed, based on an operational state of the radiator fan.

12. The abnormality diagnosis apparatus according to claim 11, wherein the abnormality diagnosis means forcefully drives the radiator fan when the vehicle speed does not satisfy a predetermined condition during the predetermined abnormality diagnosis period.

13. The abnormality diagnosis apparatus according to claim 1, further comprising:

a coolant temperature sensor that measures the coolant temperature; and a coolant temperature estimating means for estimating the coolant temperature, wherein:

the abnormality diagnosis means executes:

a first abnormality diagnosis operation to determine whether the thermostat open state abnormality exists by determining whether the thermostat abnormal time correlation exists between the radiator side released heat amount information and the vehicle speed in the predetermined warm-up incomplete temperature range of the coolant; and a second abnormality diagnosis operation to determine whether the thermostat open state abnormality exists based on the measured coolant temperature, which is measured with the coolant temperature sensor, and the estimated coolant temperature, which is estimated by the coolant temperature estimating means, in the predetermined warm-up incomplete temperature range of the coolant.

14. The abnormality diagnosis apparatus according to claim 13, wherein the abnormality diagnosis means uses one of a diagnosis result of the first abnormality diagnosis operation and a diagnosis result of the second abnormality diagnosis operation, which is completed earlier than the other one of the diagnosis result of the first abnormality diagnosis operation and the diagnosis result of the second abnormality diagnosis operation.

15. The abnormality diagnosis apparatus according to claim 13, wherein when a diagnosis result of the first abnormality diagnosis operation and a diagnosis result of the second abnormality diagnosis operation are identical to each other, the abnormality diagnosis means uses the identical diagnosis result as a final diagnosis result.

16. The abnormality diagnosis apparatus according to claim 13, wherein the abnormality diagnosis means changes a determination condition, which is used to determine whether the thermostat open state abnormality exists in the second abnormality diagnosis operation based on a correlation value, which is computed to determined the correlation between the radiator side released heat amount information and the vehicle speed in the first abnormality diagnosis operation.

* * * * *